United States Patent [19]

Kanamori et al.

[11] 4,120,785

[45] Oct. 17, 1978

[54] RUBBER SCREENS FOR VIBRATORY SCREENING APPARATUS

[75] Inventors: Katsuo Kanamori, Kobe; Nobuo Sakurai, Nishinomiya; Ryozo Arai, Kobe, all of Japan

[73] Assignee: Mitsuboshi Belting Limited, Kobe, Japan

[21] Appl. No.: 771,274

[22] Filed: Feb. 23, 1977

[30] Foreign Application Priority Data

Feb. 23, 1976 [JP] Japan ..... 51-20996[U]
Mar. 6, 1976 [JP] Japan ..... 51-26616[U]

[51] Int. Cl.[2] ..... B07B 1/28

[52] U.S. Cl. ..... 209/401; 209/392; 209/400

[58] Field of Search ..... 209/310, 394, 400–402, 209/392–393, 395, 397, 399; 428/231; 264/DIG. 81; 210/499

[56] References Cited

U.S. PATENT DOCUMENTS

| | | | |
|---|---|---|---|
| 703,683 | 7/1902 | Vrooman et al. | 209/395 |
| 1,718,386 | 6/1929 | Sherwood | 209/401 |
| 2,294,966 | 9/1942 | Dreyfus | 264/DIG. 70 |
| 2,332,373 | 10/1943 | Dorough et al. | 264/DIG. 70 |
| 3,012,674 | 12/1961 | Hoppe | 209/401 |
| 3,134,733 | 5/1964 | Rose | 209/393 |

FOREIGN PATENT DOCUMENTS

| | | | |
|---|---|---|---|
| 1,197,310 | 7/1965 | Fed. Rep. of Germany | 209/400 |
| 1,260,654 | 1/1972 | United Kingdom | 209/397 |

OTHER PUBLICATIONS

Characteristics and Uses of Kevlar 29 Aramid; Du Pont Preliminary Info Memo #375; Textile Fibers Dept., Sep. 28, 1976.

*Primary Examiner*—Robert Halper
*Assistant Examiner*—Jon Hokanson
*Attorney, Agent, or Firm*—Sughrue, Rothwell, Mion, Zinn and Macpeak

[57] ABSTRACT

A rubber screen for a vibratory screening apparatus comprises a plurality of first parallel rope members having suitable cross sectional shapes and arranged in a particle flowing direction, each of said first rope members having a tensile member composed of a strand of filament having a high elongation at break and an organic material having flexibility and/or elasticity and covering the tensile member, and a plurality of second parallel rope members having suitable cross sectional shapes and arranged in a direction normal to the first rope members, each of the second rope members having a tensile member of a material having a low elongation at break and an organic material having flexibility and/or elasticity and covering the tensile member, each point of intersection between the first and second rope members being suitably bonded.

51 Claims, 13 Drawing Figures

RUBBER SCREENS FOR VIBRATORY SCREENING APPARATUS

BACKGROUND OF THE INVENTION

This invention relates to rubber screens for use in a vibratory screening apparatus for ore concentrates in mines, blast furnaces, etc., which effectively prevent the blockage or clogging of the screen openings.

Conventional screens for iron ores, cokes, broken stones, and the like include knitted steel wire meshes, punched iron sheets, rubber screens, wedge wires, and polyurethane screens. These conventional screens have not proved entirely satisfactory, however, for one or more reasons described below with reference to FIGS. 1 to 4, in which FIG. 1 is a plan view of a conventional rubber screen with a feed particle thereon; FIG. 2 is a plan view showing the feed particle in FIG. 1 wedged into a screen opening; and FIGS. 3 and 4 are front elevations showing the particle wedged into opening, and about to fall through, respectively.

Woven metallic wire meshes and punched iron sheets have poor abrasion resistance, are frequently clogged which reduces their screening efficiency, and are very noisy in operation. Of the synthetic rubber and polyurethane screens, those of the type shown in FIGS. 1 to 4 include coreless rope members 2 arranged parallel to the feed direction (shown by the arrow), and cored rope members 1 arranged transverse to the particle flow. The rope members 1 have embedded tensile cores 3 with a low elongation coefficient, and the resulting screen undergoes comparatively little clogging. The flexible coreless rope members 2 have a high elongation coefficient, however, whereby particles S larger than the screen mesh frequently become wedged into a opening and gradually work through, as shown in FIG. 4. Thus, the properly sorted undersize particles that have fallen through the screen often contain a number of larger particles of undesired size. Further, in order to increase the abrasion resistance of the screen, the diameter of the rope members must be increased, which results in a decreased ratio of screen openings and a correspondingly reduced screening efficiency.

It is generally necessary to reduce the screen mounting tension in order to prevent clogging. In screens of the aforementioned type, however, when the mounting tension is low, the screen flutters and incessantly collides with the support frame mounted on the back of the screen. This causes screen or tensile member breakage, which markedly shortens the service life of the screen.

Present day rubber screens also include strong tensile member cores extending in both the transverse and parallel directions and the sorted particle diameter is more stable with such screens. Since low-elongation, high-modulus twisted wires are used as the cores, however, the tensile members tend to hold wedged feed particles firmly in place in the screen openings, which causes substantial blockage or clogging. Specifically, when the mesh size is less than 15 mm in the lateral and the longitudinal directions, respectively, a low tension mounting must be used for the screen in order to prevent such clogging, and as mentioned above such low tension causes undesirable collisions between the screen and the support frame.

SUMMARY OF THE INVENTION

According to one aspect of the present invention, a rubber screen for a vibratory screening apparatus comprises (1) first longitudinal rope members of various cross-sectional shapes arranged parallel to each other in the particle feed direction, each of said rope members composed of a tensile core member having a high elongation at break, such as twisted strands of natural or synthetic fibers or a twisted steel wire, and a flexible outer covering of plastic, rubbery elastomer, polyurethane, or the like, and (2) second rope members of various cross-sectional shapes arranged parallel to one another and transfers (lateral) to the feed direction, each of said second rope members consisting of a tensile core member having a low elongation at break, such as a steel wire or an aromatic polyamide fiber, and a flexible outer covering similar to that of the first rope members. The points of intersection between the rope members are bonded, such as by melt-bonding, to provide an integral and efficient screen unit having enhanced blockage resistance.

According to another aspect of the invention, a rubber screen for a vibratory screening apparatus comprises either:

(1) an intersecting laminate consisting of (a) two kinds of rope members of various cross-sectional shapes composed of a flexible plastic or rubber elastomer, and tensile members having different Young's moduli and elongations at break, the different rope members being used in definite proportions and arranged in definite structural units in the lateral direction, and (b) core-containing rope members of various cross-sectional shapes arranged in the longitudinal direction, each composed of a flexible plastic or rubber elastomer and an ordinary tensile member, such as embedded natural or synthetic fibers or steel wires, (2) an intersecting laminate consisting of (a) the same rope members as in (1) (a) above arranged in the lateral direction, and (b) coreless longitudinal rope members of various cross-sectional shapes, each composed only of a flexible plastic or rubbery elastomer, or (3) an intersecting laminate consisting of (a) longitudinally arranged rope members each composed of a mixture of the same coreless rope members as in (2) (b) above and the same core-containing rope members as in (1) (b) above, and (b) the same transversely arranged rope members as in (1) (a) above.

Again the points of intersection in each of said combinations are joined by melt-bonding or the like to provide an integral screen unit.

DETAILED DESCRIPTION OF PREFERRED EMBODIMENTS

Figure 1:
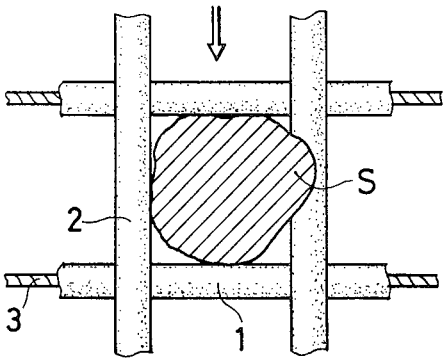
FIGS. 1 to 4 are as described above.
Figure 2:
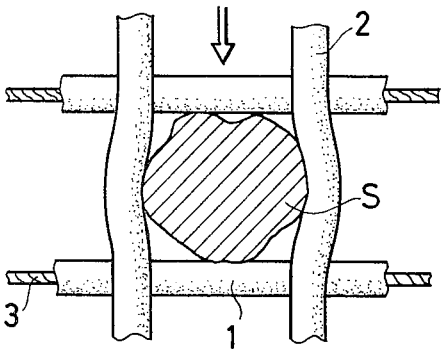
Figure 3:
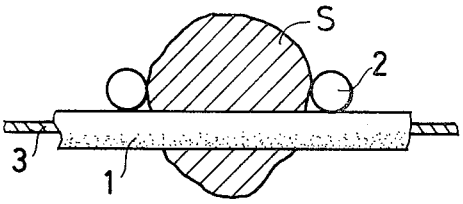
Figure 4:
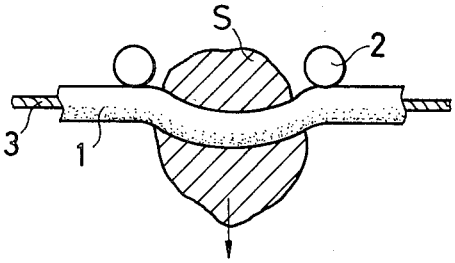
Figure 5:
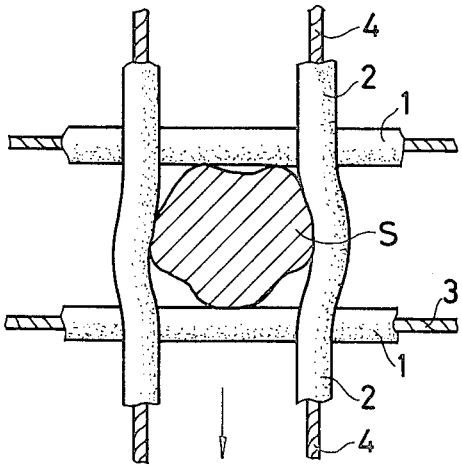
FIG. 5 is a plan view showing an embodiment of the rubber screen of this invention with a feed particle wedged in a screen opening.
Figure 6:
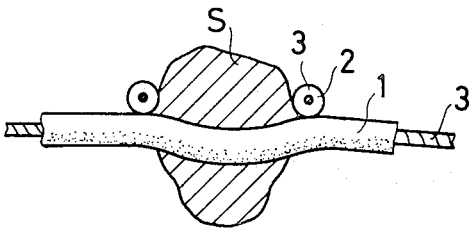
FIG. 6 is a front elevation of FIG. 5 showing the feed particle wedge into the screen opening.
Figure 7:
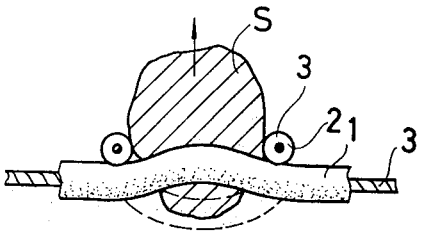
FIG. 7 is a front elevation of FIG. 5 showing the wedged particle driven out of the screen opening.

Referring to the embodiments shown in FIGS. 5 to 7, rope members 2, each consisting of a tensile member core 4, such as natural or synthetic fibers having an elongation at break of 5 to 30%, and a flexible plastic, rubber, polyurethane, or the like outer covering, are arranged parallel to one another in the feed direction as shown by the arrow. The rope members have various cross-sectional shapes, such as circular, elliptical, polygonal, or trapezoidal. Rope members 1 of the same various cross-sectional shapes, each consisting of a tensile member 3 having an elongation at break as low as 0.5 to 15%, such as steel wires or twisted strands of aromatic polyamide fibers, and the same flexible plastic rubber, polyurethane, or the like outer covering, are arranged parallel to one another either above or below the rope members 2 in a direction transverse thereto. The points of intersection are joined by melt-bonding or the like to provide an integral screen uint. As a result of the rope members 2 having a relatively high elongation, particles S larger than the screen mesh are trapped in the openings as shown in FIG. 5, and the rope members 2 temporarily deform in the feed direction. At the same time, however, only relatively slight bonding occurs in the vertical direction, and owing to the vibration of the screening apparatus, chord vibration takes place in the rope members 1. As a result, the wedged or lodged large particles S are driven upward by the chord vibration, as shown in FIG. 7, and freed from their entrapment. Thus, the blockage of the screen openings is markedly reduced, and the screening or sorting accuracy is greatly increased.

The above description has been directed to the structure and operation of a rubber screen in accordance with the first embodiment of the invention. The efficiency of such a screen will be demonstrated with refereene to the examples and test results presented below.

Example I

A screening test was performed using a rubber screen according to this invention having the specifications set forth below, and a comparison screen made of rope members composed of a steel wire tensile member core and a polyurethane outside covering, and the ratio of clogging or mesh blockage were examined. The results are shown below.

1. Rubber screen of this invention
(I) Specification of meshes: at intervals of 10mm both in the transverse and longitudinal directions
Size of the screen: Width (W) 3050mm
Length (L) 1220mm

| | Rope members (polyurethane-covered) | | | |
|---|---|---|---|---|
| | Rope diameter (mm) | Type of tensile members | Elongation of tensile members (%) | Tensile modulus of the tensile members (Kg/mm²) |
| Transverse or Tension direction | 5 | Aromatic polyamide *1500 D/3 × 2 | 4.2 | 6–6.5 × $10^3$ |
| Flow direction | 5 | Tetoron (polyester) **250 D/2 × 2 | 18 | 2 × $10^3$ |

(II) Material screened: Iron ore (particle diameter 0 to 35mm)
(III) Vibratory screening apparatus: Triple crown screening apparatus -continued (IV) Clogging ratio: less than 0.3%

*Tensile member obtained by winding two strands each strand being made by winding three filaments of 1500 denier
**Tensile member obtained by winding two strands, each strand being made by winding two filaments of 250 denier.

2. Comparison screen
(I) The specification of meshes and the size of the screen were the same as for the rubber screen of this invention.

| | Rope members (polyurethane-covered) | | | |
|---|---|---|---|---|
| | Rope diameter (mm) | Type of tensile members | Elongation of tensile members (%) | Tensile modulus of the tensile members (Kg/mm²) |
| Longitudinal direction | 5 | Steel cord 0.22 × 7 × 7 | 2 | 12–12 × $10^3$ |
| Transverse direction | 5 | Steel cord 0.22 × 7 × 7 | 2 | 12–20 × $10^3$ |

(II) Material screened: same as in 1
(III) Vibratory screening apparatus: same as in 1
(IV) Clogging ratio: approximately 30%

As the above results clearly demonstrate, the clogging ratio for the rubber screen of this invention is only approximately 1/100 that of the comparison screen, even ignoring the poor efficiency of the prior art screen.

Now, the second embodiment of the present invention will be described.

In this embodiment, there are the following types and combinations of tensile members.

Table 1

| No. | Tensile member in the lateral direction | Tensile member in the longitudinal direction |
|---|---|---|
| 1 | 1 type core | 1 type core |
| 2 | 1 type core | 2 types core - core |
| 3 | 1 type core | 2 types core - coreless |
| 4 | 2 types core - core | 1 type core |
| 5 | 2 types core - core | 1 type coreless |
| 6 | 2 types core - core | 2 types core - core |
| 7 | 2 types core - core | 2 types core - coreless |
| 8 | 2 types core - coreless | 1 type core |
| 9 | 2 types core - coreless | 1 type coreless |
| 10 | 2 types core - coreless | 2 types core - core |
| 11 | 2 types core - coreless | 2 types core - coreless |

In the above table, the "core" means a core-containing rope member, and the "coreless" means a coreless rope member.

Since it is nearly impossible for the screen to function satisfactorily when only coreless rope members are used in the lateral (tension) direction, such a situation has been omitted from table 1.

Figure 8:
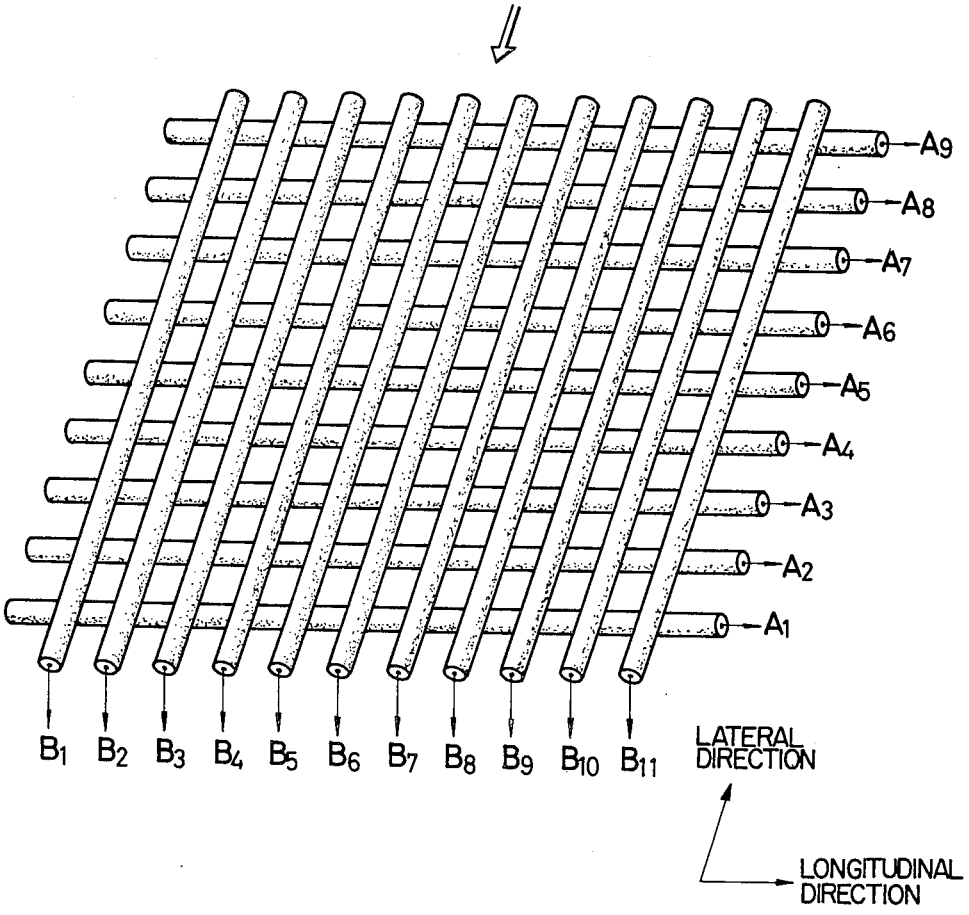
FIG. 8 is a perspective view of a core-containing rubber screen with intersecting longitudinal and transverse rope members.

On the basis of FIG. 8 which is a perspective view of a part of a polyurethane screen composed of intersecting rope members, typical combination of tensile members according to Table 1 are given in Table 2.

Table 2

| Combinations of tensile members | | | | | | | | | | | | |
|---|---|---|---|---|---|---|---|---|---|---|---|---|
| Lateral / Longitudinal / No. | $A_1$ / $B_1$ | $A_2$ / $B_2$ | $A_3$ / $B_3$ | $A_4$ / $B_4$ | $A_5$ / $B_5$ | $A_6$ / $B_6$ | $A_7$ / $B_7$ | $A_8$ / $B_8$ | $A_9$ / $B_9$ | $B_{10}$ | $B_{11}$ |
| 1 | $S_2$ | $S_2$ | $S_2$ | $S_2$ | $S_2$ | $S_2$ | $S_2$ | $S_2$ | $S_2$ | | |
| | $K_1$ / $S_1$ | $T_1$ / $K_2$ | $T_1$ / $K_2$ | $K_1$ / $S_1$ | $T_1$ / $K_2$ | $T_1$ / $K_2$ | $K_1$ / $S_1$ | $T_1$ / $K_2$ | $T_1$ / $K_2$ | $K_1$ | $T_1$ |
| 2 | $T_1$ / $S_1$ | $T_1$ / $S_1$ | $T_1$ / $S_1$ | $T_1$ / $S_1$ | $T_1$ / $S_1$ | $T_1$ / $S_1$ | $T_1$ / $S_1$ | $T_1$ / $S_1$ | $T_1$ / $S_1$ | $T_1$ | $T_1$ |
| 3 | $K_1$ / $S_1$ | $K_1$ / $S_1$ | 0 / $T_1$ | $K_1$ / $S_1$ | $K_1$ / $S_1$ | 0 / $T_1$ | $K_1$ / $S_1$ | $K_1$ / $S_1$ | 0 / $T_1$ | $K_1$ | $K_1$ |
| 4 | | | | | | | | | | | |

Table 2-continued

| Combinations of tensile members | | | | | | | | | | | |
|---|---|---|---|---|---|---|---|---|---|---|---|
| Lateral<br>Longitudinal<br>No. | $A_1$<br>$B_1$ | $A_2$<br>$B_2$ | $A_3$<br>$B_3$ | $A_4$<br>$B_4$ | $A_5$<br>$B_5$ | $A_6$<br>$B_6$ | $A_7$<br>$B_7$ | $A_8$<br>$B_8$ | $A_9$<br>$B_9$ | $B_{10}$ | $B_{11}$ |
| 5 | $T_1$<br>$S_1$ | $T_1$<br>$S_1$ | O<br>O | O<br>O | $T_1$<br>$S_1$ | $T_1$<br>$S_1$ | O<br>O | O<br>O | $T_1$<br>$S_1$ | $T_1$ | O |
| | $K_2$ | $K_2$ | $T_1$ | $T_1$ | $K_2$ | $K_2$ | $T_1$ | $T_1$ | $K_2$ | $K_2$ | $T_1$ |

The abbreviations in Table 2 have the following meanings.
A: lateral direction
B: longitudinal direction
S : steel cord (0.22 × 7 × 7)
S : steel cord (0.175 × 7 × 4)
K : aromatic polyamide (1500 D/3 × 2)
K2: aromatic polyamide (1500 D/3 × 4)
T : Tetoron No. 6 (polyester)
O: No tensile member (coreless)

Figure 9:
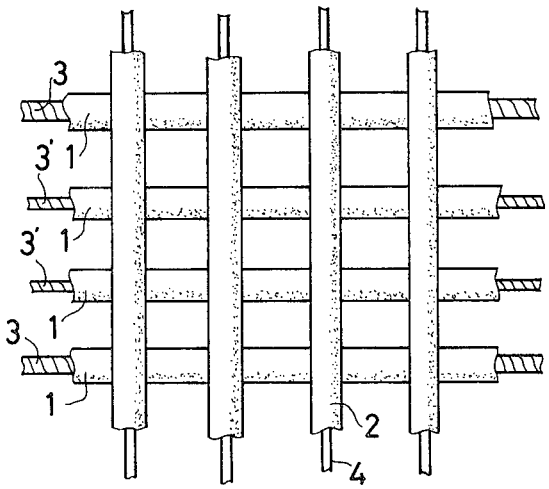
FIG. 9 is a plan view showing an intersecting arrangement of core-containing rope members.
Figure 10:
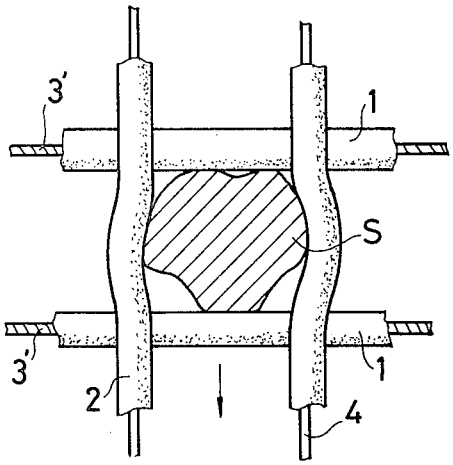
FIGS. 10 and 13 are each plan views showing further embodiments of a rubber screen according to the invention with feed particles wedged in a screen opening.
Figure 11:
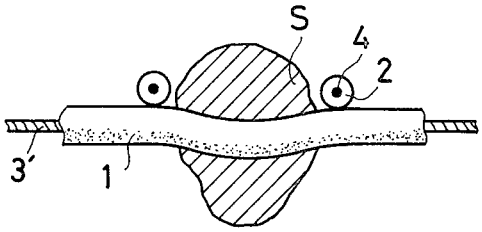
FIG. 11 is a front elevation of FIG. 10.

Nos. 1, 2, 3, 4 and 5 correspond to Nos. 2, 4, 3, 7 and 10 in Table 1, respectively. Referring to FIG. 9 and taking No. 2 in Table 2 as an example, the reference numeral 1 represents rope members in the lateral direction; 3, a steel cord; 3', an aromatic polyamide tensile member; and 2, rope members in the longitudinal or particle flowing directional having embedded therein a tensile member 4 made of Tetoron. FIGS. 10 to 13 are views showing the rubber screen of this invention and the stages of the screen for particles to be used therethrough. In FIG. 10, rope members 2 of various cross-sectional shapes such as circular, elliptic, polygonal or trapezoidal shapes which are composed of a Tetoron tensile member 4 having a relatively high elongation at break of 5 to 30% and a flexible plastic, rubbery elastomer, polyurethane or the like covering the outside surface of the tensile member are arranged in parallel to one another in the flow direction of the particle S. On the other hand, in the tension direction at right angles to the flow direction, core-containing rope members 1 of the same various shapes as those of the rope members in the flow direction which are composed of either an aromatic polyamide tensile member 3' having an elongation at break of as low as 0.5 to 15% or a steel cord tensile member having a low elongation and a flexible plastic, rubbery elastomer, polyurethane or the like covering the outside surface of the tensile member are arranged on or below the plane made by the rope members 2 in a direction at right angles thereto. Each of intersections of the rope members and core containing rope members is bonded or melt-bonded to provide screen.

Figure 12:
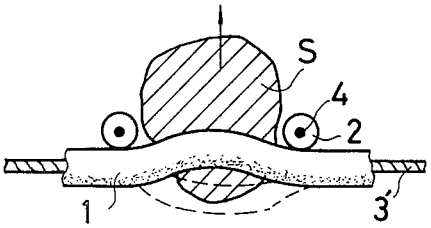
FIG. 12 is a front elevation showing the feed particle in FIG. 10 being driven out of the screen opening.

In FIG. 10, a pair of aromatic polyamide tensile members 3' having a low elongation and a pair of rope members 2 having embedded therein the Tetoron tensile member 4 having a relatively high elongation at break of 5 to 30% will be considered. When paricle (S) having a size larger than the size of the screen opening defined by the tensile members 3' and the rope members 2 is placed on the screen, the screen opening slightly deforms to trap the particle (S) in the screen opening. However, by actuating the vibratory screening apparatus to produce secondary vibrations of different amplitudes and frequencies in the rope members 2 in the flowing direction, the trapped particle (S) is vibrated and thrown away from the opening as shown in FIG. 12. Thus, clogging of the screen opening can be prevented.

In the above embodiment, the two tensile members 3' of the rope members 1 in the tension direction are made of an aromatic polyamide. The second aspect of this invention, however, is characterized by using, in either the tension or flowing direction, 10 to 90% of rope members having a high elongation tensile member embedded therein and 90 to 10% of rope member having embedded therein a low elongation tensile member having an elongation at break of 0.5 to 15%. Thus, in one direction of the screen, low-elongation rope members and high-elongation rope members are distributed. Hence, there are boundaries between the low-elongation rope members and the high-elongation rope members in the screen openings.

Figure 13:
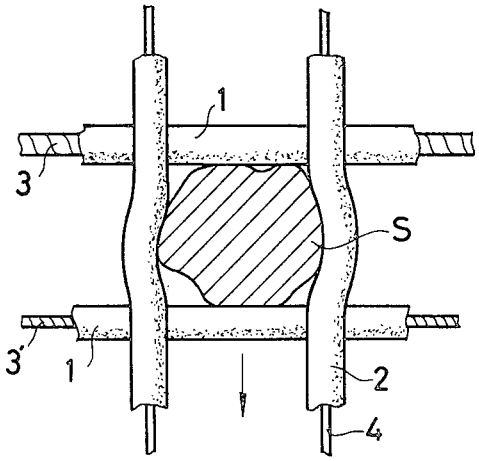

FIG. 13 is a plan view showing the boundary portion of the screen opening. In this embodiment, low-elongation aromatic polyamide member 3' and low-elongation steel cord 3 are embedded in the rope members 1 in the tension direction respectively. When a particle (S) having a larger size than that of the screen opening is placed on the screen, the rope members 1 in the tension direction are neither stretched nor deformed as in the case of FIG. 10 because the tensile members 3 and 3' have low elongations at break though the values are different. On the other hand, the rope members 2 in the flowing direction are slightly deformed because of the high-elongation Tetoron tensile member 4 thereof and cause the particles (S) to be trapped in the opening. However, as in the case of FIG. 10, it is thrown away from the opening by the secondary vibration caused by the vibratory screening apparatus. Thus, the clogging of the screen openings can be reduced.

Further, for example, aromatic polyesters (such as Tetoron), or aliphatic polyamides (such as nylon 6) can be used as tensile members having a high elongation, and aromatic polyamides (such as fiber B), or steel wires can be used as tensile members having a low elongation.

The rubber screen described above is for the case of No. 2 in Table 2. In the longitudinal direction of combination No. 2, one structural unit consists of a steel cord, an aromatic polyamide yarn and an aromatic polyamide yarn in that order.

The present invention, however, is not limited to this structural unit consisting of one type tensile member and a couple of another type tensile members. According to this invention, in rope members having embedded therein two or more kinds of tensile members having different Young's moduli and elongations at break which are arranged either in the longitudinal or transverse direction, $m$ rope members each having a low-elongation tensile member are juxtaposed with other $n$ rope members each having embedded therein a tensile member having a high Young's modulus or a low elongation to form a structural unit containing $(m + n)$ rope members, and a plurality of such units are repeatingly arranged in the longitudinal or transverse direction, where $m$ is a positive integer up to 20 and $n$ is a positive integer up to 10.

In the present invention, coreless rope members may be usde in either the longitudinal or transverse direction as shown in Nos. 3, 4 and 5 in Table 2. The coreless rope members have elongation and elasticity, but their repulsive elasticity for throwing out particles trapped in an opening by secondary vibration is poor. Accordingly, when coreless rope members are used together with core-containing members, the undersize particles which should pass through the screen openings may partially accumulate and or clogging of the screen openings may occur. In order to eliminate these disadvantages coreless rope members are combined with core-containing rope members so that the area of the coreless portion becomes only a small percentage of the entire screen area. Furthermore, due to the presence of core-containing rope members is a major proportion, the screen has sufficient repulsive elasticity.

The screening efficiency of a rubber screen according to the second aspect of the invention will be shown by the following Example (clogging test).

EXAMPLE 2

In the same way as in Example 1, a screening test was performed using a rubber screen in accordance with this invention and a comparison screen composed of rope members each having a steel wire as a tensile member covered by polyurethane and the clogging of the screen openings was examined.

1. Rubber screen
(I) Distance between rope members: 10mm both in longitudinal and transverse direction Screen size: Width (W) 3050mm
Length (L) 1220mm

| | Rope members (polyurethane-covered) | | | |
|---|---|---|---|---|
| | Rope member diameter (mm) | Type of tensile members | Elongation of tensile members (%) | Tensile modulus of tensile members (Kg/mm$^2$) |
| Tension | 5 | Aromatic polyamide (1500 D/3 × 4) | 4.2 | 6–6.5 × $10^3$ |
| Flowing direction | 5 | Aromatic polyamide (1500 D/3 × 4) | 4.2 | 6–6.5 × $10^3$ |
| | | Tetoron (250 D/2 × 2) | 18 | 2 × $10^3$ |

(II) Material screened: iron ore (particle size 0 to 35mm)
(III) Vibratory screening apparatus: Triple crown screening apparatus
(IV) Clogging: less than 0.7%

2. Comparison screen
(I) The rope member interval and the size of the screen were the same as those of the rubber screen in 1 above.

| | Rope members (polyurethane-covered) | | | |
|---|---|---|---|---|
| | Diameter of rope members (mm) | Type of tensile members | Elongation of tensile members (%) | Tensile modulus of tensile members (Kg/mm$^2$) |
| Longitudinal direction | 5 | Steel cord (0.22 × 7 × 7) | 2 | 12–20 × $10^3$ |
| Transverse direction | 5 | Steel cord (0.22 × 7 × 7) | 2 | 12–20 × $10^3$ |

(II) Material screened: same as in 1 above
(III) Vibratory screening apparatus: same as in 1 above
(IV) Clogging: 30%

The above results clearly shows that the clogging of the rubber screen of this invention is 1/40 that of the comparison rubber screen having only steel cords as tensile members.

What we claim is:

1. A rubber screen for a vibratory screening apparatus, comprising a plurality of first parallel rope members having suitable cross-sectional shapes and arranged in a particle flowing direction, each of said first rope members having a tensile member composed of a strand of filaments having a high elongation at break and an organic material having flexibility and/or elasticity covering said tensile member, and a plurality of second parallel rope members having suitable cross-sectional shapes and arranged in a direction normal to said first rope members, each of said second rope members having a tensile member of a material having a low elongation at break and an organic material having flexibility and/or elasticity and covering said tensile member; each of the points of intersection between said first and second rope members being suitably bonded, the elongation at break of said first parallel rope members as a whole being greater than the elongation at break of said second parallel rope members as a whole.

2. The rubber screen as claimed in claim 1, wherein said tensile member of said first rope member has an elongation at break of 5 to 30%.

3. The rubber screen as claimed in claim 1, wherein said tensile member of said second rope member has an elongation at break of 0.5 to 15%.

4. A rubber screen for vibratory screening apparatus as claimed in claim 1, wherein each of said first and second rope members has a circular cross section.

5. A rubber screen for vibratory screening apparatus as claimed in claim 1, wherein each of said first and second rope members has an elliptical cross section.

6. A rubber screen for vibratory screening apparatus as claimed in claim 1, wherein each of said first and second rope members has a trapezoidal cross section.

7. A rubber screen for vibratory screening apparatus as claimed in claim 1, wherein each of said first and second rope members has a polygonal cross section.

8. A rubber screen for vibratory screening apparatus as claimed in claim 1, wherein said first rope members are disposed on said second rope members.

9. A rubber screen for vibratory screening apparatus as claimed in claim 1, wherein said first rope members are disposed below said second rope members.

10. A rubber screen for a vibratory screening apparatus, comprising, a plurality of lateral parallel rope member units each including at least a first rope member and at least a second rope member arranged in parallel to said first rope member, said first rope member being composed of a first tensile member having a first Young's modulus and a first elongation at break and an organic material having flexibility and/or elasticity and covering said first tensile member, said second rope member being composed of a second tensile member having a second Young's modulus and a second elongation at break and an organic material having flexibility and/or elasticity and covering said second tensile member, the ratio of the number of said first rope members to that of said second rope members and the arrangement of said first and second rope members in each of said units being constant; and a plurality of longitudinal third rope members arranged in a particle flowing direction, parallel to each other, and normal to the direction of said lateral rope member units, each of said third rope members being composed of a third tensile member and an organic material covering said third tensile member, each of the points of intersection of said first and second rope members and said third rope members being suitably bonded to form an intersecting lamination, the elongation at break of said lateral rope member units as a whole being less than the elongation at break of said longitudinal rope members as a whole.

11. A rubber screen for vibratory screening apparatus as claimed in claim 10, wherein each of said first, second and third rope members has a circular cross section.

12. A rubber screen for vibratory screening apparatus as claimed in claim 10, wherein each of said first, second and third rope members has an elliptical cross section.

13. A rubber screen for vibratory screening apparatus as claimed in claim 10, wherein each of said first, second and third rope members has a trapezoidal cross section.

14. A rubber screen for vibratory screening apparatus as claimed in claim 10, wherein each of said first, second and third rope members has a polygonal cross section.

15. A rubber screen for vibratory screening apparatus as claimed in claim 10, wherein said ratio is 1/9 to 9/1.

16. A rubber screen for vibratory screening apparatus as claimed in claim 15, wherein said rope member unit includes $m$ of said first rope members and $n$ of said second rope members where $m$ is a positive integer up to 20 and $n$ is a positive integer up to 10 and wherein said first and second rope members are arranged alternatively.

17. A rubber screen for vibratory screening apparatus as claimed in claim 10, wherein said first elongation at break is 5 to 30% and said second elongation at break is 0.5 to 15% and wherein said ratio is 1/9 to 9/1.

18. A rubber screen for vibratory screening apparatus as claimed in claim 17, wherein said first tensile member is a strand of aromatic polyester and said second tensile member is a strand of aromatic polyamide.

19. A rubber screen for vibratory screening apparatus as claimed in claim 18, wherein said rope member unit includes $m$ of said first rope members and $n$ of said second rope members where $m$ is a positive integer up to 20 and $n$ is a positive integer up to 10 and wherein said first and second rope members are arranged alternatively.

20. A rubber screen for vibratory screening apparatus as claimed in claim 17, wherein said first tensile member is a strand of aliphatic polyamide and said second tensile member is a strand of aromatic polyamide.

21. A rubber screen for vibratory screening apparatus as claimed in claim 17, wherein said first tensile member is a strand of aromatic polyester and said second tensile member is a strand of metal wire.

22. A rubber screen for vibratory screening apparatus as claimed in claim 17, wherein said first tensile member is a strand of aliphatic polyamide and said second tensile member is a strand of metal wire.

23. A rubber screen for vibratory screening apparatus as claimed in claim 17, wherein said first tensile member is a strand of aromatic polyamide and said second tensile member is a strand of metal wire.

24. A rubber screen for vibratory screening apparatus as claimed in claim 10, wherein said lateral rope member units are disposed on said third rope members.

25. A rubber screen for vibratory screening apparatus as claimed in claim 10, wherein said lateral rope member units are disposed below said third rope members.

26. A rubber screen for a vibratory screening apparatus, comprising lateral parallel rope member units each including at least a first rope member and at least a second rope member arranged in parallel to said first rope member, said first rope member being composed of a first tensile member having a first Young's modulus and a first elongation at break and an organic material having flexibility and/or elasticity and covering said first tensile member, said second rope member being composed of a second tensile member having a second Young's modulus and a second elongation at break and an organic material having flexibility and/or elasticity and covering said second tensile member, the ratio of the number of said first rope members to that of said second rope members and the arrangement of said first and second rope members in each of said units being constant; and a plurality of longitudinal third rope members each composed of an organic material having flexibility and/or elasticity, said third rope members being arranged in a particle flowing direction, parallel to each other, and normal to the direction of said lateral rope member units; each of the points of intersection of said first and second rope members and said third rope members being suitably bonded to form an intersecting lamination, the elongation at break of said longitudinal rope member units as a whole being higher than the elongation at break of said lateral rope member units as a whole.

27. A rubber screen for vibratory screening apparatus as claimed in claim 26, wherein each of said first, second and third rope members has a circular cross section.

28. A rubber screen for vibratory screening apparatus as claimed in claim 26, wherein each of said first, second and third rope members has an elliptical cross section.

29. A rubber screen for vibratory screening apparatus as claimed in claim 26, wherein each of said first, second and third rope members has a trapezoidal cross section.

30. A rubber screen for vibratory screening apparatus as claimed in claim 26, wherein each of said first, second and third rope members has a polygonal cross section.

31. A rubber screen for vibratory screening apparatus as claimed in claim 26, wherein said ratio is 1/9 to 9/1.

32. A rubber screen for vibratory screening apparatus as claimed in claim 31, wherein said rope member unit includes $m$ of said first rope members and $n$ of said second rope members where $m$ is a positive integer up to 14 and $n$ is a positive integer up to 10 and wherein said first and second rope members are arranged alternatively.

33. A rubber screen for vibratory screening apparatus as claimed in claim 26, wherein said first elongation at break is 5 to 30% and said second elongation at break is 0.5 to 15% and wherein said ratio is 1/9 to 9/1.

34. A rubber screen for vibratory screening apparatus as claimed in claim 33, wherein said first tensile member is a strand of aromatic polyester and said second tensile member is a strand of aromatic polyamide.

35. A rubber screen for vibratory screening apparatus as claimed in claim 33, wherein said first tensile member is a strand of aliphatic polyamide and said second tensile member is a strand of aromatic polyamide.

36. A rubber screen for vibratory screening apparatus as claimed in claim 33, wherein said first tensile member is a strand of aromatic polyester and said second tensile member is a strand of metal wire.

37. A rubber screen for vibratory screening apparatus as claimed in claim 33, wherein said first tensile member is a strand of aliphatic polyamide and said second tensile member is a strand of metal wire.

38. A rubber screen for vibratory screening apparatus as claimed in claim 33, wherein said first tensile member is a strand of aromatic polyamide and said second tensile member is a strand of metal wire.

39. A rubber screen for vibratory screening apparatus as claimed in claim 33, wherein said rope member unit includes $m$ of said first rope members and $n$ of said second rope members where $m$ is a positive integer up to 20 and $n$ is a positive integer up to 10 and wherein said first and second rope members are arranged alternatively.

40. A rubber screen for vibratory screening apparatus as claimed in claim 26, wherein said lateral rope member units are disposed on said third rope members.

41. A rubber screen for vibratory screening apparatus as claimed in claim 26, wherein said lateral rope member units are disposed below said third rope members.

42. A rubber screen for vibratory screening apparatus, comprising a plurality of longitudinal parallel rope member units each including at least a first rope member and at least a second rope member arranged in a particle flowing direction, parallel to said first rope member, said first rope member being composed of an organic material having flexibility and/or elasticity, said second rope member being composed of a first tensile member and an organic material covering said first tensile member; a plurality of lateral parallel rope member units each including at least a third rope member arranged normally to the direction of said first rope member unit and at least a fourth rope member arranged in parallel to said third rope members and normally to the direction of said first rope member unit, said third rope member being composed of a second tensile member having a first Young's modulus and a first elongation at break and an organic material having flexibility and/or elasticity and covering said second tensile member, said fourth rope member being composed of a third tensile member having a second Young's modulus larger than said first Young's modulus and a second elongation at break and an organic material having flexibility and/or elasticity and covering said third tensile member, the ratio of the number of said third rope members to that of said fourth rope members and the arrangement of said third and fourth rope members in each of said second units being constant; each of the points of intersections of said longitudinal rope member units and said third and fourth rope members of said lateral rope member units being suitably bonded to form an intersecting lamination, the elongation at break of said longitudinal rope member units as a whole being higher than the elongation at break of said lateral rope member units as a whole.

43. A rubber screen for vibratory screening apparatus as claimed in claim 42, wherein each of said first, second, third and fourth rope members has a circular cross section.

44. A rubber screen for vibratory screening apparatus as claimed in claim 42, wherein each of said first, second, third and fourth rope members has an elliptical cross section.

45. A rubber screen for vibratory screening apparatus as claimed in claim 42, wherein each of said first, second, third and fourth rope members has a trapezoidal cross section.

46. A rubber screen for vibratory screening apparatus as claimed in claim 42, wherein each of said first, second, third and fourth rope members has a polygonal cross section.

47. A rubber screen for vibratory screening apparatus as claimed in claim 42, wherein said ratio is 1/9 to 9/1.

48. A rubber screen for vibratory screening apparatus as claimed in claim 42, wherein said first elongation at break is 5 to 30% and said second elongation at break is 0.5 to 15% and wherein said ratio is 1/9 to 9/1.

49. A rubber screen for vibratory screening apparatus as claimed in claim 42, wherein the numbers of said third and fourth rope members are $m$ and $n$ where $m$ is a positive integer up to 20 and $n$ is a positive integer up to 10 and wherein said third and fourth rope members are arranged alternatively.

50. A rubber screen for vibratory screening apparatus as claimed in claim 42, wherein said lateral rope member units are disposed on said lateral rope member units.

51. A rubber screen for vibratory screening apparatus as claimed in claim 42, wherein said longitudinal rope member units are disposed below said latral rope member units.

* * * * *